United States Patent [19]

Watanabe

[11] Patent Number: 4,583,174

[45] Date of Patent: Apr. 15, 1986

[54] ELECTRONICALLY CONTROLLED FUEL INJECTION APPARATUS FOR INTERNAL COMBUSTION ENGINE

[75] Inventor: Haruo Watanabe, Okazaki, Japan

[73] Assignee: Toyota Jidosha Kabushiki Kaisha, Japan

[21] Appl. No.: 520,316

[22] Filed: Aug. 4, 1983

Related U.S. Application Data

[63] Continuation-in-part of Ser. No. 252,387, Apr. 9, 1981, abandoned.

[30] Foreign Application Priority Data

Apr. 14, 1980 [JP] Japan ..... 55-49063

[51] Int. Cl.[4] ..... F02D 5/02; F02D 35/00; F02P 5/08

[52] U.S. Cl. ..... 364/431.07; 123/339; 123/493; 364/431.05

[58] Field of Search ..... 364/431.05, 431.06, 364/431.07, 431.11; 123/339, 340, 353, 417, 486, 492, 493

[56] References Cited

U.S. PATENT DOCUMENTS

| | | | |
|---|---|---|---|
| 3,964,457 | 6/1976 | Coscia | 123/339 X |
| 4,047,507 | 9/1977 | Noguchi et al. | 123/340 |
| 4,172,433 | 10/1979 | Bianchi et al. | 123/486 |
| 4,181,461 | 1/1980 | Leung | 123/492 X |
| 4,244,023 | 1/1981 | Johnson | 123/417 X |
| 4,245,599 | 1/1981 | Des Lauriers | 123/353 |
| 4,296,722 | 10/1981 | Furuhashi et al. | 123/492 |
| 4,306,527 | 12/1981 | Kinugawa et al. | 123/339 |
| 4,344,397 | 8/1982 | Geiger et al. | 123/339 |
| 4,380,979 | 4/1983 | Takase | 123/339 |
| 4,385,596 | 3/1983 | Hosaka | 123/493 X |
| 4,440,119 | 4/1984 | Kobayashi et al. | 123/493 X |

FOREIGN PATENT DOCUMENTS

| | | | |
|---|---|---|---|
| 2727804 | 1/1979 | Fed. Rep. of Germany | 123/493 |
| 54-59509 | 5/1979 | Japan | 123/339 |
| 56-146025 | 11/1981 | Japan | 123/339 |
| 57-88242 | 6/1982 | Japan | 123/339 |

OTHER PUBLICATIONS

Gorille et al.: Bosch Electronic Fuel Injection with Closed Loop Control, E paper #750368, (Society of Automotive Engineers), 1975, pp. 137/144.

*Primary Examiner*—Felix D. Gruber
*Attorney, Agent, or Firm*—Parkhurst & Oliff

[57] ABSTRACT

An electronically controlled fuel injection apparatus for internal combustion engine which increases the rate of fuel injection when the engine speed drops by a rate more than a predetermined rate under a condition that the aperture of the throttle valve is minimum, that is, under an idling condition. In order to increase the rate of fuel injection, the width of the basic fuel injection pulse is enlarged which is given according to the engine speed and the intake air flow rate, or, in addition to the basic fuel injection pulse, a predetermined rate of fuel is injected asynchronously, i.e., independently from the crank angle of the engine.

6 Claims, 6 Drawing Figures

ELECTRONICALLY CONTROLLED FUEL INJECTION APPARATUS FOR INTERNAL COMBUSTION ENGINE

This is a continuation-in-part of the application Ser. No. 252,387 filed Apr. 9, 1981 now abandoned.

BACKGROUND OF THE INVENTION

1. Field of the Invention

The present invention relates to an electronically controlled fuel injection apparatus for an internal combustion engine, and particularly to an apparatus for stabilizing the engine speed under idling condition.

2. Description of the Prior Art

In a conventional electronically controlled fuel injection apparatus, it is common to supply an amount of fuel injection which is proportional to the amount of suction air per excursion of the engine or the amount of suction air per excursion divided by an engine rotation speed. In an idling mode or constant velocity running mode, however, a constant and stable engine output is required. The engine output or the engine rotation speed, however, changes due to external disturbances such as small change in a load or variance in a burning rate, and unstable idling state or surging takes place. Such problems are serious particularly when a lean air-to-fuel ratio is set to reduce air pollusion by exhaust gas or exhaust gas recirculation control value (EGR) is used, or when a low idling rotation is set to save fuel consumption.

In a prior art system, the amount of fuel injection is changed when the amount of suction air or the engine rotation speed changes to compensate for the change in the load or the rotation speed. However, the compensation based on the amount of suction air or the engine rotation speed (at least one rotation) cannot completely compensate for the stability of the engine.

SUMMARY OF THE INVENTION

The present apparatus is invented in order to remove the above disadvantages in the prior art.

The object of the present invention is to provide an electronically controlled fuel injection apparatus for an internal combustion engine which is capable of keeping the engine speed constant under idling condition.

In order to achieve the above object, the apparatus according to the present invention increases the rate of fuel injection when the engine acceleration drops by a rate more than a predetermined rate under a condition that the aperture of the throttle valve is minimum, that is, under an idling condition. In order to increase the quantity of fuel injection, the width of the basic fuel injection pulse is enlarged which is given according to the engine acceleration and the intake air flow rate, or, in addition to the basic fuel injection pulse, a predetermined quantity of fuel is injected asynchronously, i.e., independently from the crank angle of the engine.

Therefore, the present invention has advantages that when the engine speed drops, for example, due to additional loads, the quantity of fuel injection is increased synchronously to or asynchronously from the crank angle so as to prevent the stall and surging of the engine. As a result, the engine speed is kept constant under idling condition.

DETAILED DESCRIPTION OF THE PREFERRED EMBODIMENTS

The present invention will be explained in detail with reference to the preferred embodiment.

Figure 1:
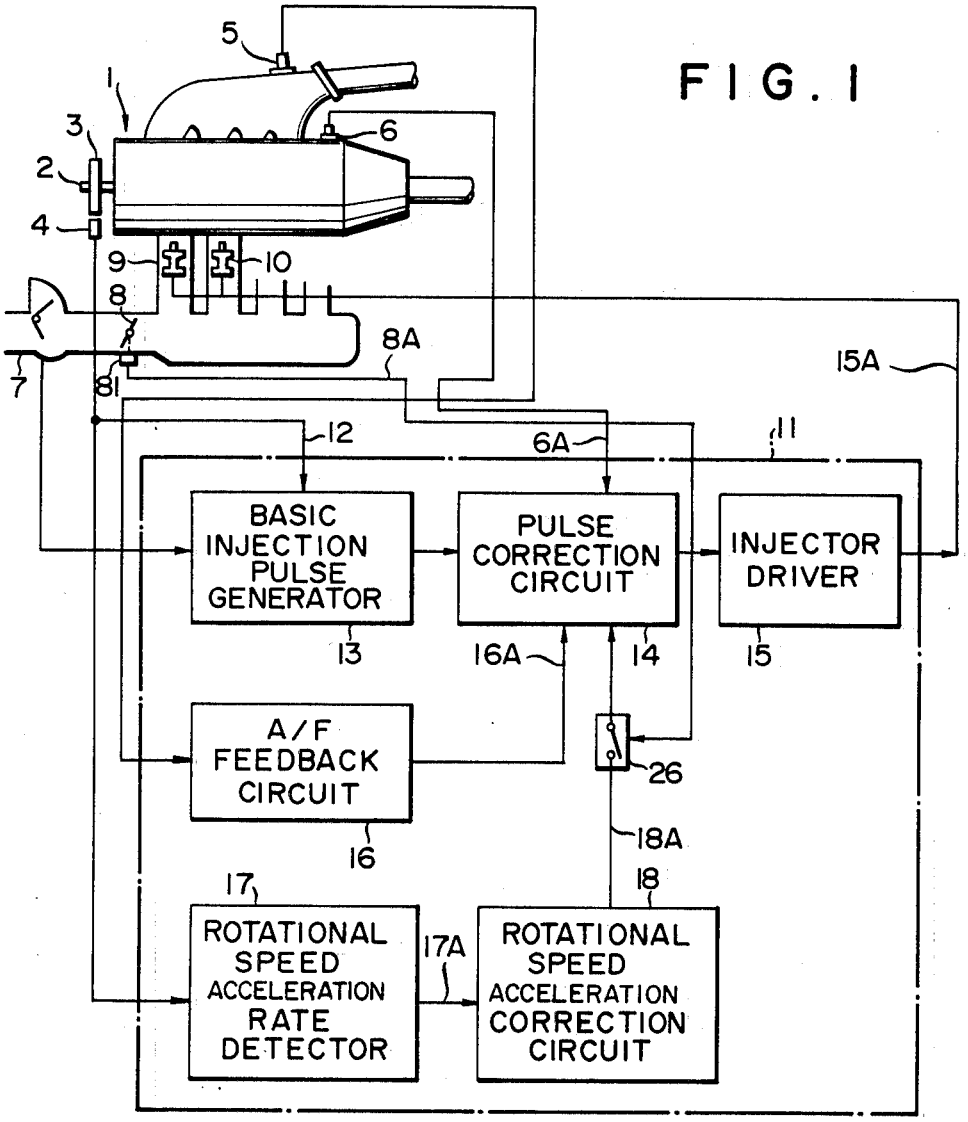
FIG. 1 is a block diagram showing an embodiment of the present invention.

FIG. 1 shows an analogue circuit diagram of one embodiment of the present invention. In the illustrated embodiment, numeral 1 denotes an engine and a rotating member 3 for indicating a crank position is fixed to a crank shaft 2. A crank angle sensor 4 is displaced close to the rotating member 3. The engine 1 is provided with an $O_2$ sensor 5 and a water temperature sensor 6, and an air flow meter 7 detects the amount of suction air to the engine 1. Numeral 8 denotes a throttle valve and an injector 10 is mounted in a suction pipe 9. Numeral 81 defines an idle switch which turns on when the aperture of the throttle valve is minimized under an idling condition.

A control unit for controlling the engine is designated by numeral 11. The control circuit 11 includes a basic injection pulse generating circuit 13 for generating an injection pulse per engine revolution. Normally, an engine rotation signal 12 from a primary winding of an ignition coil is supplied to the basic injection pulse generating circuit 13. The circuit 13 is connected to a pulse correction circuit 14 which is connected to an injector drive circuit 15 for driving an injector 10. The injector drive circuit 15 supplies an injector drive signal 15A to the injector 10.

Applied to the pulse correction circuit 14 are, in addition to the signal from the basic injection pulse generating circuit 13, a water temperature sensor signal 6A from the water temperature sensor 6, an air-fuel ratio correction signal 16A supplied from the $0_2$ sensor 5 through an air-fuel ratio feedback circuit 16. A rotation acceleration signal 17A is generated by a rotation speed acceleration rate detection circuit 17 and applied to a rotation acceleration correction circuit 18. This circuit corrects the signal 17A so as to generate a rotation acceleration correction signal 18A, which is fed through a analogue switch 26 to the circuit 14. The switch 26 is turned on when the idle switch 81 is turned on. In the present embodiment, the acceleration variation correction circuit 18 functions to calculate a correction amount based on a deviation of the rotation variation rate signal 17A supplied from the rotation speed acceleration rate detection circuit 17 from a predetermined value or on a predetermined function.

Figure 5:
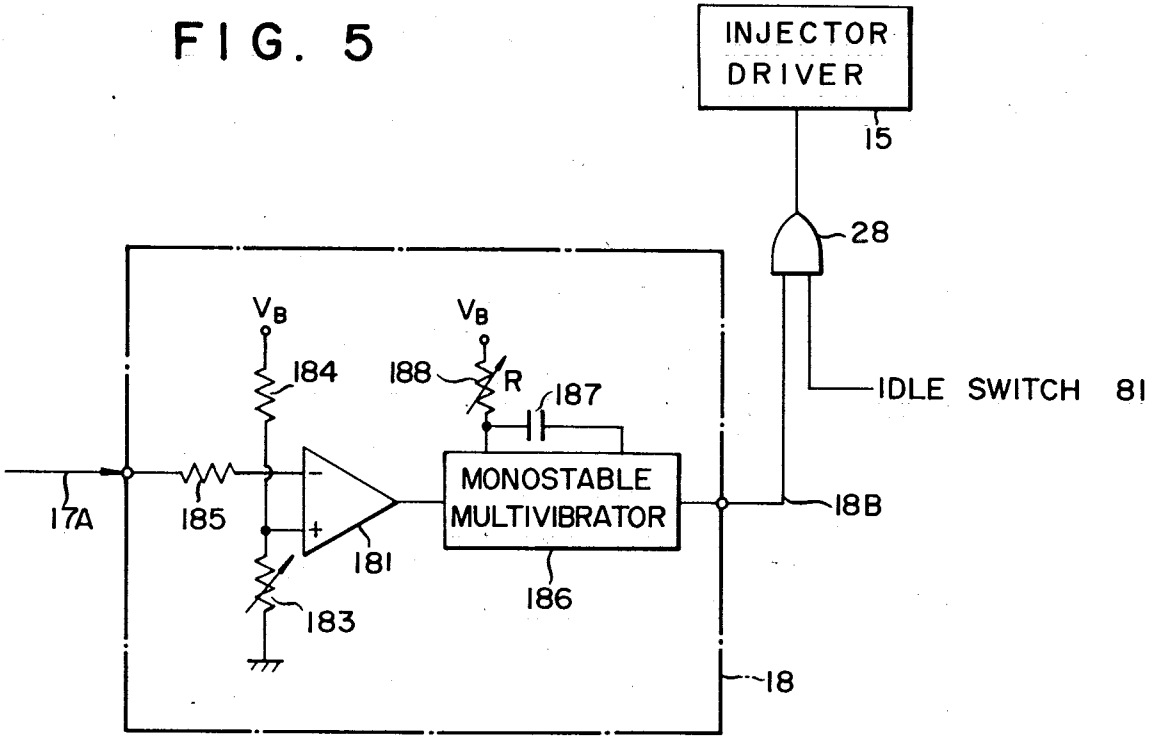
FIG. 5 is a circuit diagram partially showing another embodiment.
Figure 6:
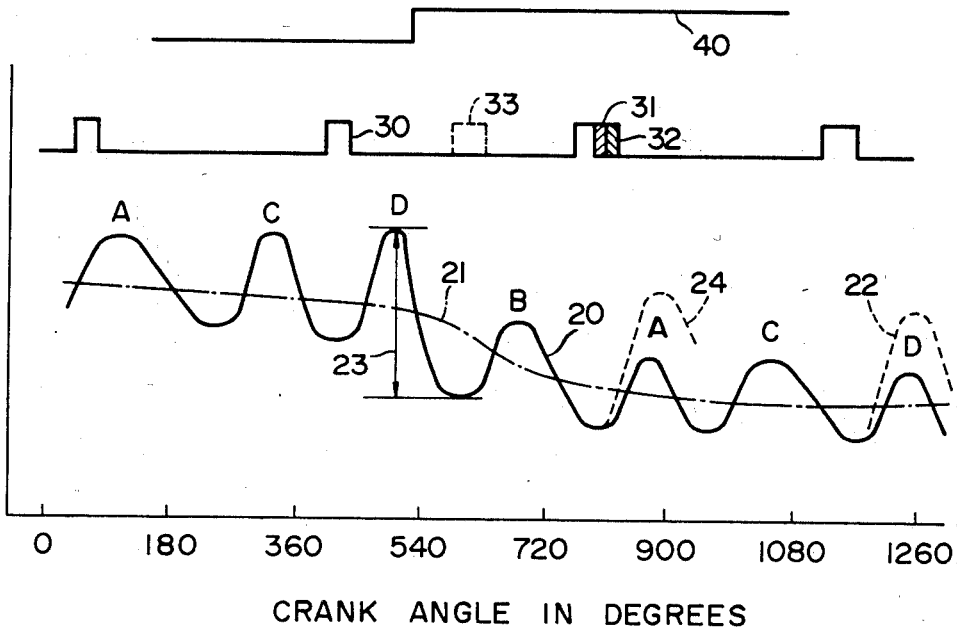
FIG. 6 is a chart for illustrating a change in the engine speed under idling condition of a four-cylinder engine to which the embodiment of FIG. 1 is applied.

As shown in FIG. 5, the rotation acceleration correction circuit 18 may produce another injection pulse signal 18B, in addition to the normal injection pulse signal, to the injector drive circuit 15 when an absolute value of a negative portion of the rotation acceleration rate signal 17A exceeds a predetermined level, to drive the injector 10. In this case, the engine rotation can be more stabilized.

Figure 2:
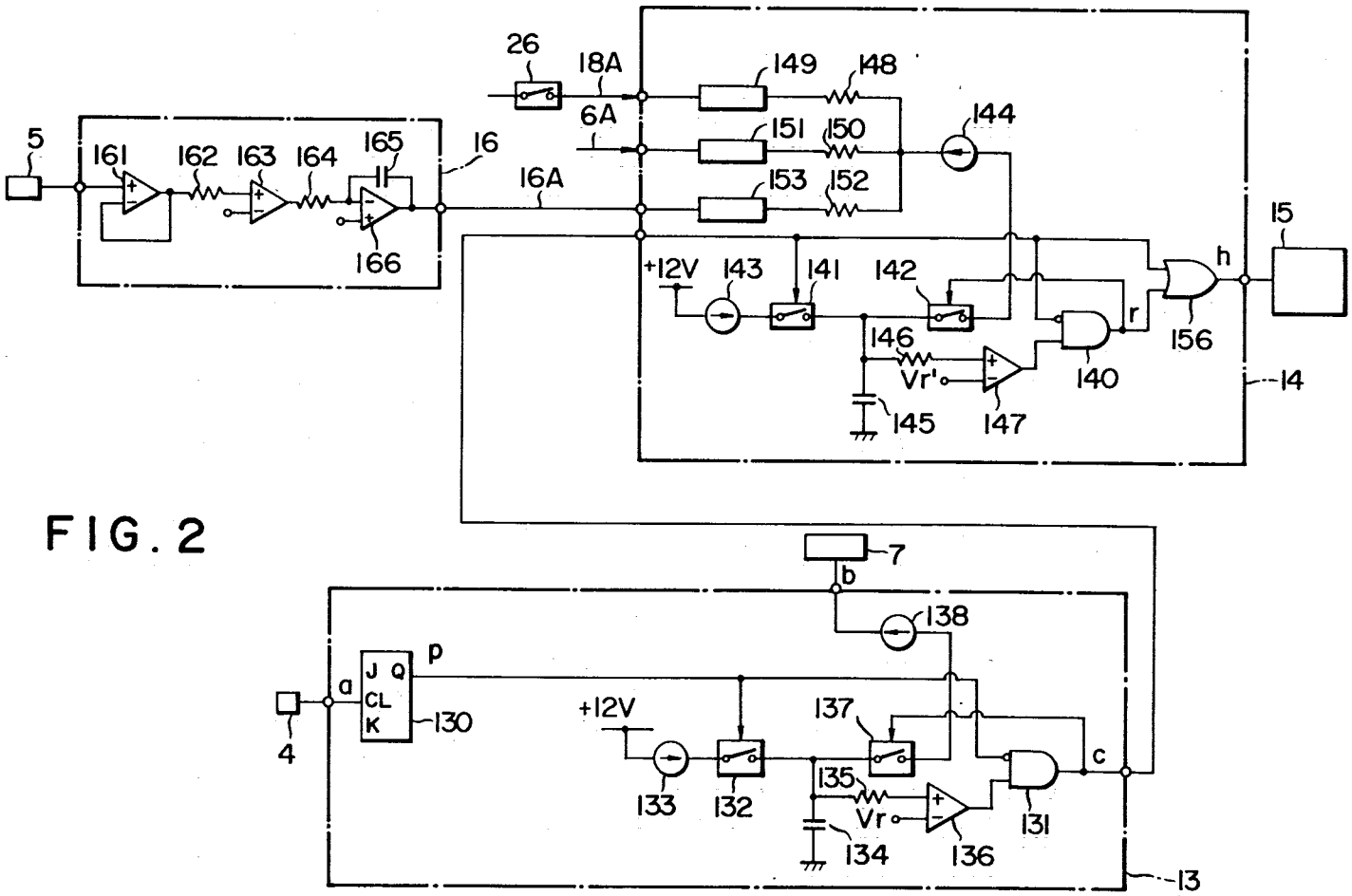
FIGS. 2 and 3 are circuit diagrams showing the details of the above embodiment.

A block diagram of the circuit shown in FIG. 1 will now be described in detail with reference to FIGS. 2 and 3. The basic injection pulse generator 13 comprises: a JK-Flip-Flop (JK-FF) 130, an AND gate 131, one of input terminals of which is connected to the Q terminal of the JK-FF 130; and a first analogue switch 132 connected to the Q terminal of the JK-FF 130. An end of the first analogue switch 132 is connected to a power source through V/I converter 133 to convert voltage into current. The other end of the first analogue switch 132 is grounded through a capacitor 134 to determine the time period, for which current is supplied to the injector, connected to a positive input terminal of the comparator 136 through a resistor 135, and connected to an end of a second analogue switch 137. The other end of the second analogue switch 137 is connected to an air flow meter 7 through an V/I converter 138. An output terminal of the comparator 136 is connected to the other of the input terminals of the AND gate 131. An output terminal of the AND gate 131 is connected to the second analogue switch 137 and also connected to the pulse correction circuit 14.

The air-fuel ratio feedback circuit 16 is a series circuit comprising a voltage follower consisting of an operational amplifier 161, resistor 162, comparator 163, and an integrator circuit including a resistor 164, a capacitor 165 and an operational amplifier 166. An output terminal of this integrator circuit is connected to the pulse correction circuit 14.

The pulse correction circuit 14 having an arrangement substantially similar to the basic injection pulse generator 13, includes: an AND gate 140; analogue switches 141 and 142; V/I converters 143 and 144; a capacitor 145; a resistor 146; and a comparator 147. The V/I converter 144 is connected to the analogue switch 26 through a resistor 148 and a signal conversion circuit 149 for extending the discharging time of the capacitor 145 to thereby extend the fuel injection time, connected to the water temperature sensor 6 through a resistor 150 and a signal conversion circuit 151 similar to the above, and further connected to the air-fuel ratio feedback circuit 16 through a resistor 152 and a signal conversion circuit 153 similar to the above. Numeral 156 denotes an AND gate.

Figure 3:
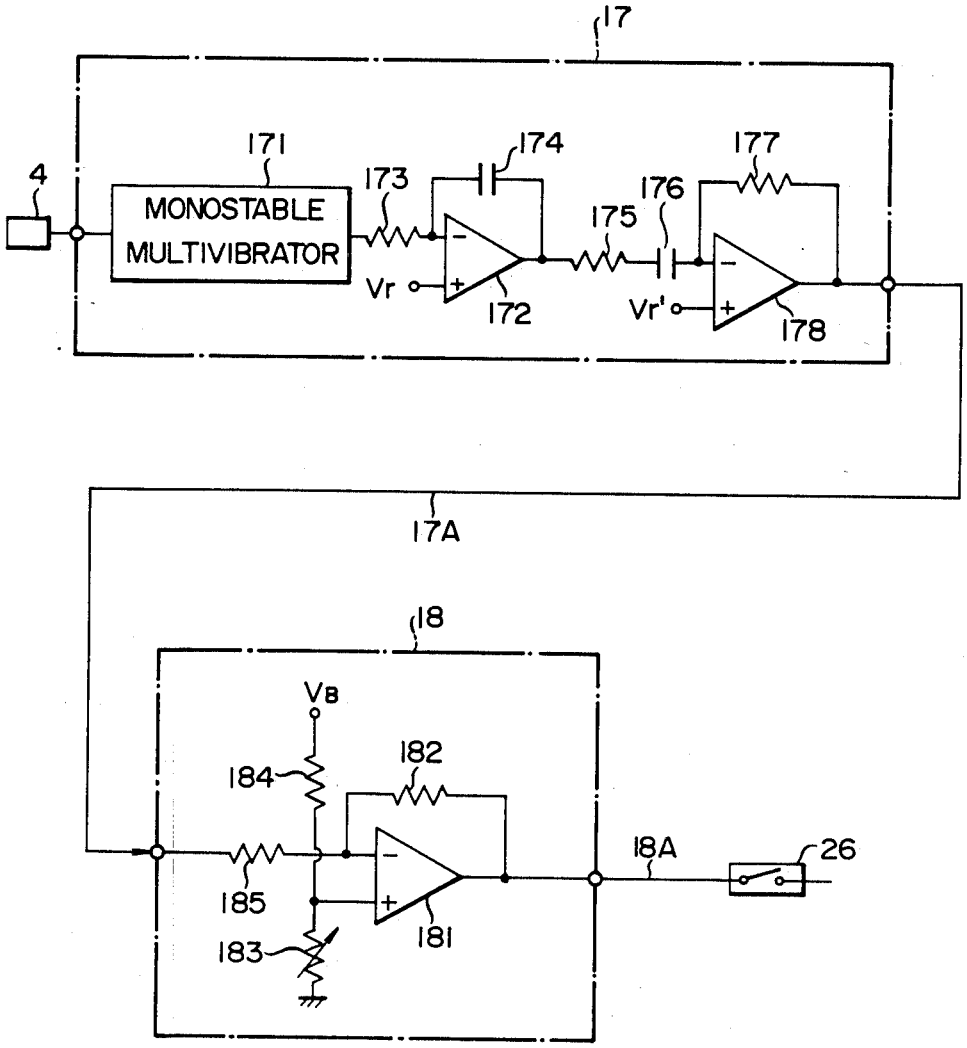

The rotation speed acceleration rate detector 17 and the rotation speed acceleration correction circuit 18 are illustrated in detail in FIG. 3. The rotation speed acceleration rate detector 17 consists of a monostable multivibrator 171 connected to the crank angle sensor 4, an integration circuit including an operational amplifier 172, resistor 173 and capacitor 174, and a differential circuit including resistors 175 and 177, capacitor 176 and operational amplifier 178. The rotation speed acceleration correction circuit 18 consists of a diferential amplifier including an operational amplifier 181 and resistors 182 to 185. The resistors 183 and 184 are provided for determining a negative reference voltage. The crank angle sensor 4 feeds an engine speed signal to the monostable multivibrator, which devides the engine speed signal. The divided engine speed signal is as a frequency signal fed to the integration circuit which converts the frequency signal into a voltage signal, that is, the integration circuit is a F/V convertor. The voltage signal is fed to the diferential circuit which diferentiates the voltage signal so as to generate an engine speed acceleration rate signal as a voltage signal. The engine speed acceleration rate signal is fed to the diferential amplifier in which the engine speed acceleration rate signal is compared with the negative reference voltage determined by the registors 183 and 184. When the engine speed acceleration rate signal is negative and is greater in absolute value than the absolute value of the reference voltage, the diferential amplifier generates a correction signal with value in proportional to the deference between the absolute values of the engine speed acceleration rate signal and the reference voltage.

The operation of the present embodiment will now be explained.

Figure 4:
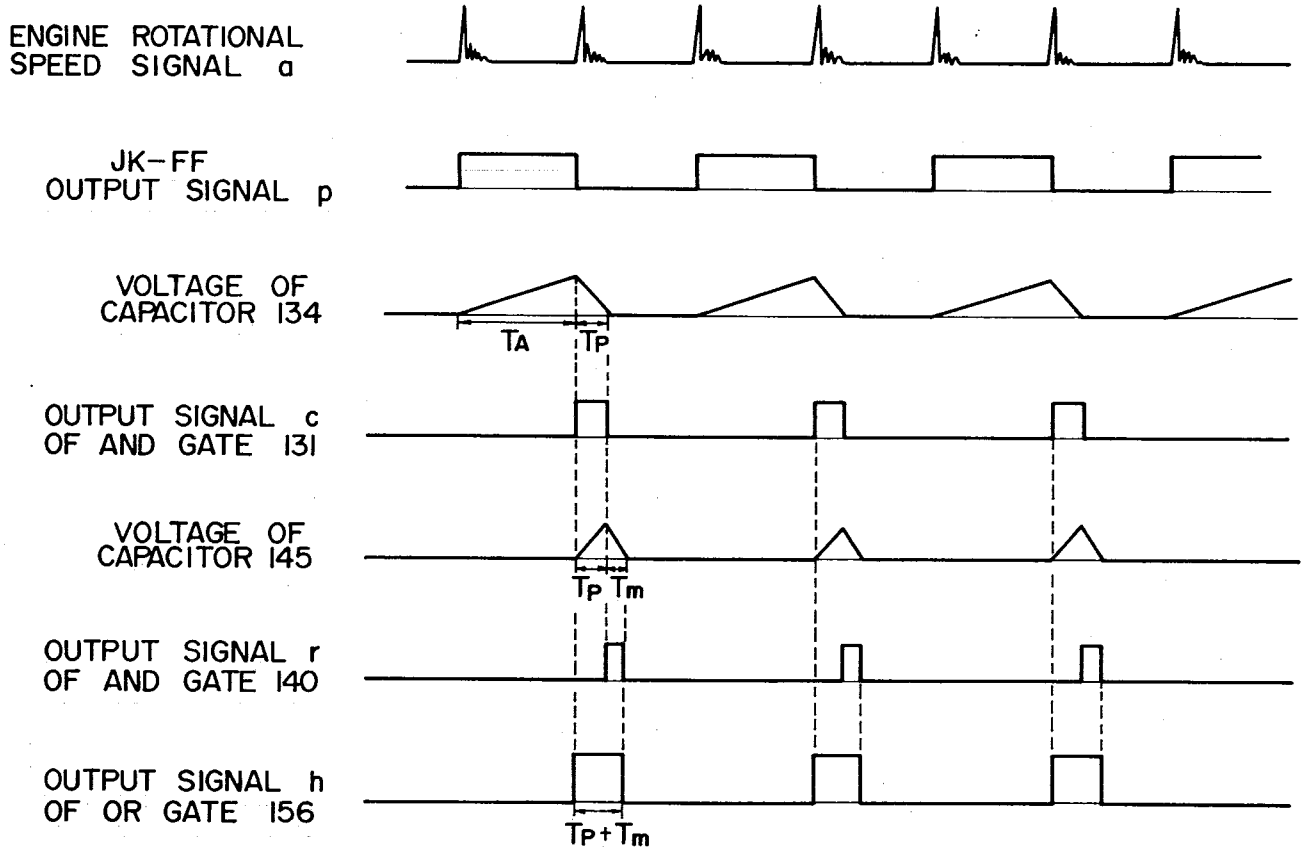
FIG. 4 is a diagram showing wave forms in portions in the circuit shown in FIGS. 2 and 3.

The engine rotation speed signal a has a waveform shown in FIG. 4. The engine rotation speed signal a frequency-divided by the JK-FF 130 and produced as a signal P shown in FIG. 4.

Since the output signal c from the AND gate 131 and the output signal r from the AND gate 140 are applied to the OR gate 156, a pulse signal h having a pulse width $T_p+T_m$ shown in FIG. 4 is produced and the injector is controlled by this pulse width.

It will be apparent from the above, since the analogue switch 26 is turned on under the idling condition, the correction signal 18A is fed to the correction circuit 14 so that the width of the basic fuel injection pulse is enlarged and the rate of fuel injection is increased synchronously to the crank angle, when the engine speed decelarates at a rate more than a predetermined rate.

Hereafter, another embodiment of the present invention is explained. In this embodiment, when the engine speed decelarates at a rate more than a predetermined rate under the idling condition, fuel is asynchronously injected from the crank angle in addition to the basic fuel injection. FIG. 5 partially shows a circuit diagram of the embodiment. The arrangement omitted in FIG. 5 of the embodiment is same as the corresponding arrangement of FIG. 1.

In this embodiment, the rotation acceleration correction circuit 18 consists of a diferential amplifier including operational amplifier 181 and resistors 183 and 184, and a monostable multivibrator 186 which may be, for example, SN74LS121. The multivibrator includes a capacitor 187 and a resistor 188 for determining the width of output pulses. The output terminal of the correction circuit 18 is connected to one input terminal on the AND circuit 28, the other input terminal of which is connected with the idle switch 81. The output terminal of the AND circuit 28 is connected to the injection driver circuit 15.

In this embodiment, since the idle switch 81 is turned on under the idling condition, when the engine speed decelarates at a rate more than a predetermined rate, the multivibrator 186 feeds a pulse with a predetermined width to the injection driver circuit 15 so as to cause the fuel injection independently from the basic fuel injection pulses, that is, asynchronously from the crank angle.

What is claimed is:

1. An electronically controlled fuel injection apparatus for an internal combustion engine which controls the amount of fuel supplied to said internal combustion engine by controlling an injector, comprising:

engine speed detecting means for detecting a speed of said engine;

intake air flow rate amount detecting means for detecting the intake air flow rate supplied to said engine;

idling condition sensing means for sensing that a throttle valve is operated to be the minimum aperture;

basic injection pulse generating means for determining a basic fuel injection time according to the engine speed and the intake air flow rate so as to generate a pulse for opening the injector while the pulse is generated, said pulse having a width corresponding to said basic fuel injection time; and correction means for enlarging the width of said pulse for opening the injector when the engine decelerates at a rate more than a predetermined rate under idling condition, said correction means enlarging the width of said pulse by a width in proportion to the engine speed deceleration rate.

2. An electronically controlled fuel injection apparatus for an internal combustion engine according to claim 1, said correction means comprising:

rotation speed variation rate detecting means for detecting the speed acceleration rate of the engine; and rotation speed acceleration correction means for generating a correction signal when the engine speed acceleration rate is negative and greater in its absolute value than a predetermined value, said correction signal representing a value in proportion to the diference between the absolute value and the predetermined rate.

3. An electronically controlled fuel injection apparatus for an internal combustion engine according to claim 2, wherein the detection of the acceleration rate of the engine rotation speed made in one cycle.

4. An electronically controlled fuel injection apparatus for an internal combustion engine which controls the amount of fuel supplied to said internal combustion engine by controlling an injector, comprising:

engine rotation speed detecting means for detecting a rotation speed of said engine;

intake air flow rate detecting means for detecting the intake air flow rate supplied to said engine;

idling condition sensing means for sensing that a throttle valve is operated to be the minimum aperture;

basic injection pulse generating means for determining a basic fuel injection time according to the engine speed and the intake air flow rate so as to generate a pulse for opening the injector while the pusle is generated, said pulse having a width corresponding to said basic fuel injection time; and correction means for generating a pulse with a predetermined width for opening the injector independently from the pulse generated by said basic injection pulse generating means when the engine speed decelerates at a rate more than a predetermined rate under idling condition.

5. An electronically controlled fuel injection apparatus for an internal combustion engine according to claim 4, said correction means comprising:

rotation speed variation rate detecting means for detecting the speed acceleration rate of the engine; and rotation speed acceleration correction means for generating said pulse with a predetermined width when the engine speed rotation rate is negative and greater than a predetermined value.

6. An electronically controlled fuel injection apparatus for an internal combustion engine according to claim 5, wherein the detection of the acceleration rate of the engine rotation speed made in one cycle.

* * * * *